US005509885A

United States Patent [19]

Brunlid

[11] Patent Number: 5,509,885

[45] Date of Patent: Apr. 23, 1996

[54] CREASING APPARATUS

[75] Inventor: John-Erik Brunlid, Lund, Sweden

[73] Assignee: Tetra Alfa Holdings & Finance S.A., Pully, Switzerland

[21] Appl. No.: 128,566

[22] Filed: Sep. 29, 1993

Related U.S. Application Data

[63] Continuation of Ser. No. 912,988, Jul. 14, 1992, abandoned.

[30] Foreign Application Priority Data

Aug. 8, 1991 [SE] Sweden ..... 9102313

[51] Int. Cl.[6] ..... B31B 1/25

[52] U.S. Cl. ..... 493/396; 493/160; 493/59; 493/60

[58] Field of Search ..... 493/396, 404, 493/468, 61, 60, 59, 160

[56] References Cited

U.S. PATENT DOCUMENTS

| | | | |
|---|---|---|---|
| 1,367,675 | 2/1921 | Tibbitts . | |
| 2,421,457 | 6/1947 | Lindsay | 493/396 |
| 2,586,744 | 2/1952 | Troth | 493/61 |
| 3,554,070 | 1/1971 | Boyd | 493/60 |
| 3,557,277 | 1/1971 | Brodersen et al. | 493/404 |
| 4,765,604 | 8/1988 | Trogan | 270/39 |
| 4,816,015 | 3/1989 | Holder et al. | 493/355 |
| 4,936,818 | 6/1990 | Holohan, Jr. | 493/471 |

FOREIGN PATENT DOCUMENTS

| | | | |
|---|---|---|---|
| 2683674 | 11/1988 | France | B31B 1/25 |
| 2638674 | 5/1990 | France | 493/61 |
| 3545169 | 7/1987 | Germany . | |

OTHER PUBLICATIONS

PCT International Publication No. WO88/01221.

*Primary Examiner*—Bruce M. Kisliuk
*Assistant Examiner*—Eileen P. Morgan
*Attorney, Agent, or Firm*—Burns, Doane, Swecker & Mathis

[57] ABSTRACT

The present invention relates to a creasing apparatus with a male part with bars and a cooperating female part with grooves. Elastic material elements are inlaid in the grooves of the female part. The elements are pretensioned and locked in their grooves by means of T-shaped end pieces.

10 Claims, 2 Drawing Sheets

CREASING APPARATUS

Figure 1:
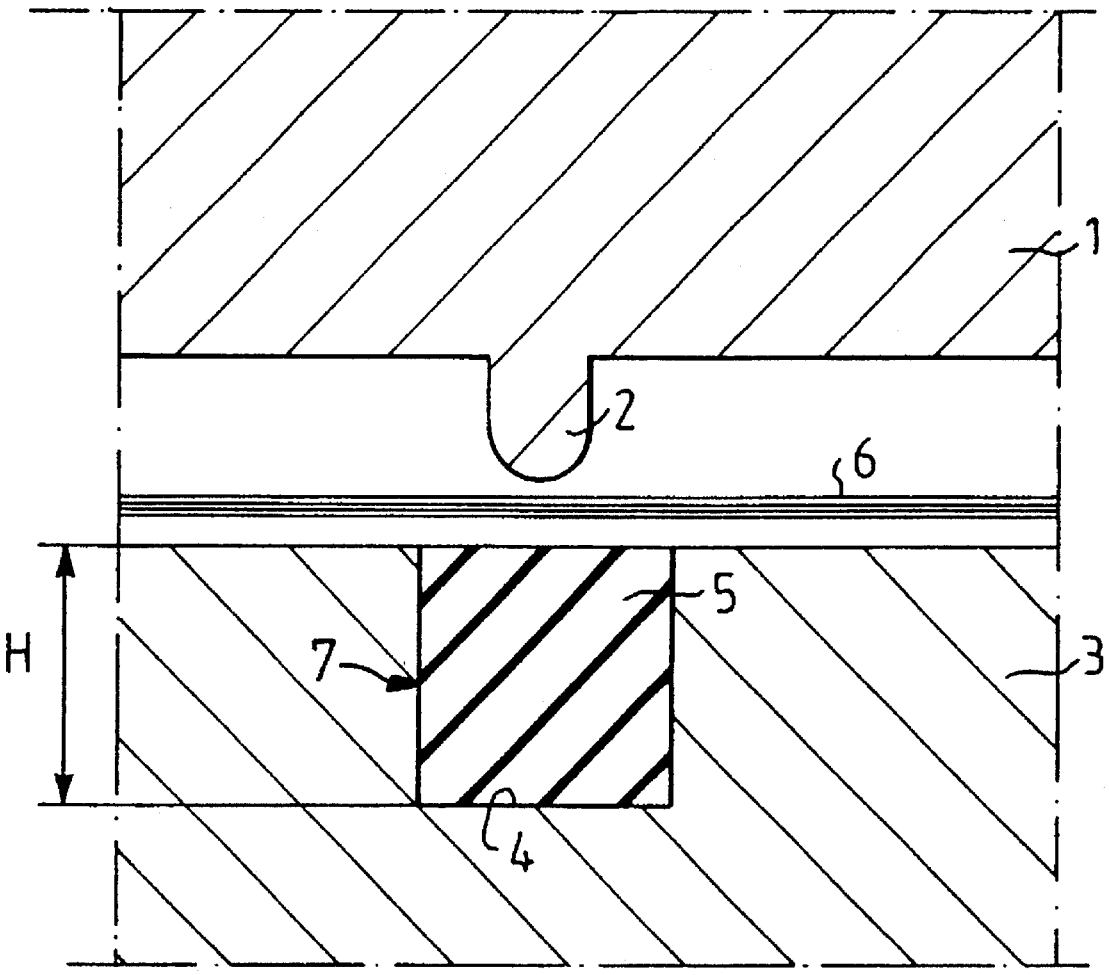

This application is a continuation of application Ser. No. 07/912,988, filed Jul. 14, 1992 now abandoned.

TECHNICAL FIELD

This present invention relates to machines for folding and forming packaging containers such as boxes and cartons, and more particularly relates to an apparatus for forming creases in board or cardboard laminate packaging materials.

The present invention relates to a creasing apparatus consisting of a male part provided with bars and a female part corresponding to the male part and provided with grooves.

BACKGROUND ART

Packaging materials for liquid packages consisting of board or cardboard laminated with thermoplastic and possibly aluminium foil are normally provided with fold lines, so-called crease lines which are made when the packaging material is in web form. These crease lines are made using creasing tools which normally consist of a male part with bars and a corresponding female part provided with grooves. In conventional creasing, these tools are made of metal, with or without a surface coating. The crease line is made in that the material passes between the male and female parts of the creasing tool and, when both of the tool parts are forced towards one another, the packaging material is broken between the parts so that crease lines occur.

Since the packaging material is forced between the two metal parts of the tool, the material is exposed to quite large stresses and, instead of forming a distinct crease line, the tool may bring about the creation of two folding or crease lines, and may also cause the packaging material in the process to be partly delaminated and thereby weakened. Trials have been carried out in which the entire female part of the tool has been provided with a rubber coating, but because of tensions in the rubber, it has not been possible in this manner to obtain perfect creases. Similarly, it is difficult in this case to obtain a pitch stroke which is constant throughout. The pitch stroke is the packaging length which must always be uniform in order to ensure that all packages have the same volume and size.

OBJECTS OF THE INVENTION

One object of the present invention is to devise a creasing apparatus which may execute distinct crease lines without weakening the material. In addition, the creasing apparatus must be relatively economical to manufacture.

A further object of the present invention is that the creasing apparatus be easy to install at various settings, and require few or no adjustments.

These and other objects have been attained according to the present invention in that the creasing apparatus of the type described by way of introduction has been given the characterizing feature that elastic material elements are inlaid in the grooves of the female part.

Preferred embodiments of the present invention have further been given the characterizing features as set forth in the appended subclaims.

BRIEF DESCRIPTION OF THE ACCOMPANYING DRAWINGS

Figure 2:
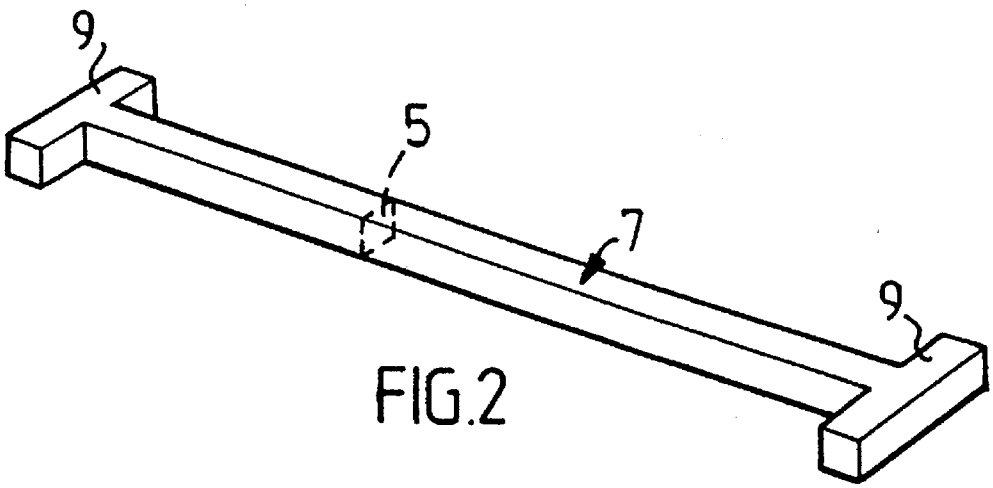
Figure 3:
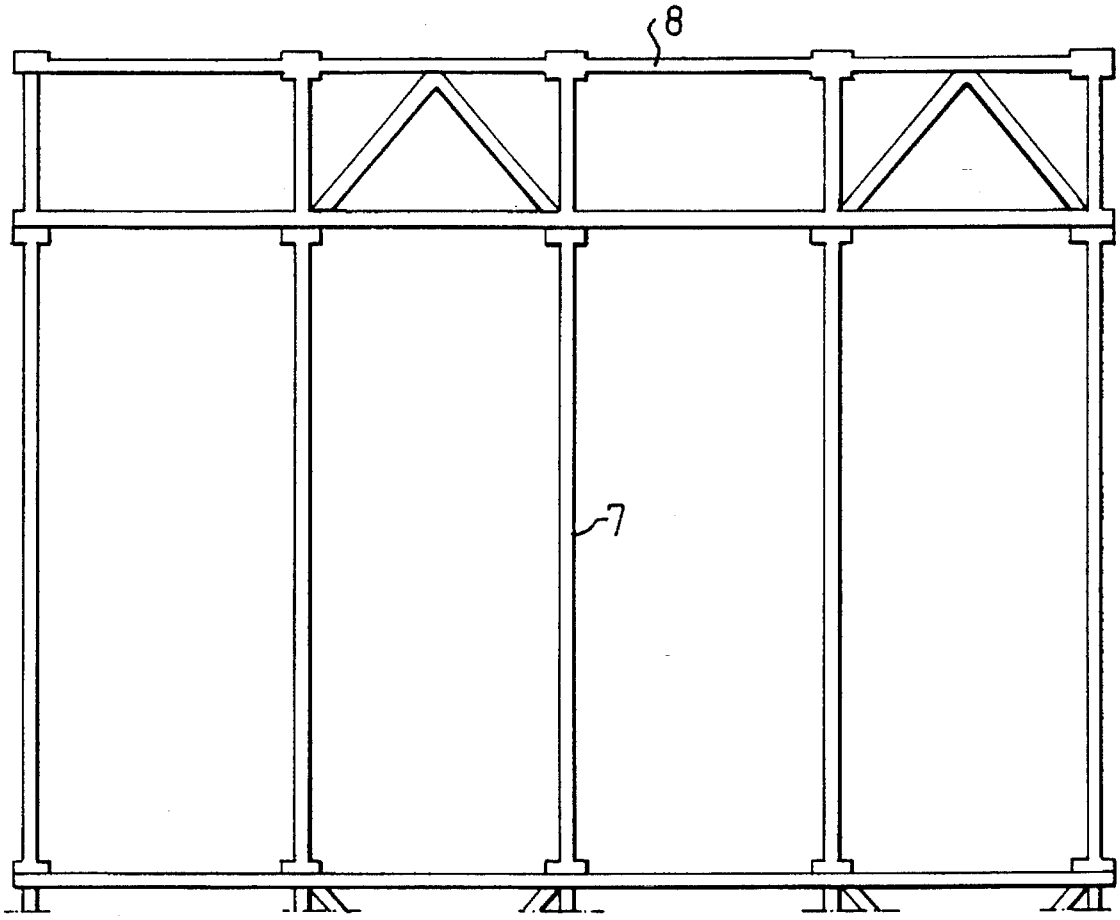

One preferred embodiment of the present invention will now be described in greater detail hereinbelow, with particular reference to the accompanying Drawings in which:

FIG. 1 is a cross-sectional schematic view of a portion of a creasing apparatus according to an embodiment of the present invention, FIG. 2 is a perspective view of an elastic element according to an embodiment of the present invention; and FIG. 3 is a top plan view of a creasing pattern a female part having inlaid elastic elements.

The Drawings show only those details which are essential to an understanding of the present invention.

DETAILED OF PREFERRED EMBODIMENT

The creasing apparatus as illustrated in FIG. 1 consists of a male part 1 with bars 2 upstanding from the surface, the bars being clearly rounded-off, and a female part 3 corresponding to the male part 1. Grooves 4 are milled in the female part 3 and profiles 5 of elastic material elements 7 are inlaid in these grooves. In the preferred embodiment, the elastic material is rubber, such as urethane rubber and of a hardness corresponding to 90°–97° Shore. Tests have shown that a rubber hardness of approx. 93° Shore is often suitable. Softer rubber qualities, below 90° Shore, require a greater pressure between the tool parts in order to obtain an acceptable crease line. Harder rubber qualities, above 97° Shore, suffer from insufficient elasticity and have properties which begin to liken those of steel.

Both of the parts 1 and 3 of the creasing apparatus can be designed as plates which are forced towards one another with the packaging material 6 therebetween, but are normally designed as two rollers with the packaging material 6 passing between them.

The rubber profiles 5 of the elements 7 may be of different appearances, but FIG. 2 shows a basic element 7 having a square cross section which corresponds to the cross section of the groove 4. The dimensions of the profile 5 may vary, but for most practical applications it is sufficient with a profile which is 6×6 mm. The intention is to have as few rubber parts as possible without, to that end, risking that the tools become difficult to adjust in their settings.

FIG. 3 shows other types of elements 8 which may occur. FIG. 3 shows a crease pattern in which the elastic elements 7, 8 are laid out. Of course, the larger elements 8 can be divided into smaller elements if this is considered suitable in order that as many parts as possible can readily be replaceable.

The basic element 7 according to FIG. 2 has an elongate configuration and, in both ends, T-shaped end pieces 9 which are also of square cross section. The T-shaped end pieces 9 are employed to lock the element 7 having the profile 5 fixedly in the groove 4 and this feature also makes it possible for the profiles 5 of the elements 7 to be slightly pretensioned when they are applied into the grooves 4. A tensioning of between 2 and 20% may be appropriate. Practical experiments demonstrate that a pretensioning of approx. 7% is sufficient. Otherwise, the profiles 5 of the elements 7 lie loose in the grooves 4 and move somewhat in the direction of rotation when the tools consist of two counteroperating rollers. As a result of the pretensioning, the rubber material constantly compensates for those stresses which occur in the crease making process and a correct mutual spacing between the crease lines in the packaging material 6 will be obtained.

By varying the height H of the profile 5, of the element 7 a different pressure on the crease line can be obtained. Alternatively, different heights of the bars 2 of the male part 1 may be employed. Hereby, it is possible to vary the pressure on the different creases in a crease pattern and by such means achieve an optimum creasing procedure.

Creasing with a tool according to the present invention is gentle on the packaging material 6 given that the packaging material is not pressed between two metal parts. Moreover, the tool proper will be subject to less wear since it is a metal part in the male tool 1 which is forced against an elastic material in the female part 3. This is particularly suitable on creasing of clay coated packaging materials 6, since otherwise the clay particles wear out the tool parts.

As a result of the creasing apparatus according to the present invention, the tool as a whole is much easier to adjust than conventional creasing tools, since the rubber profiles 5 of the elements 7 inlaid in the grooves 4 of the female part 3 are wider than the bar 2 of the male part 1. Trials have also demonstrated that a preset tool needs no subsequent re-adjustment.

The creasing apparatus according to the present invention also makes it possible for the profiles 5 of the elements 7 divided into elements to be easily replaced if a profile 5 were to become worn out or damaged. Since only one profile element 7 may perhaps need to be replaced on a female part 3, the service life of the tools will be prolonged.

As is apparent from the above description, the present invention realizes a creasing apparatus which gives distinct and exactly placed crease lines. The creasing apparatus contributes in the gentle treatment of the packaging material and also assists in ensuring that certain packaging materials do not wear out the parts of the creasing apparatus. Furthermore, the creasing apparatus is relatively economical to manufacture, easy to adjust at different settings and its various parts are readily replaceable.

The present invention should not be considered as restricted to that described above and shown on the Drawings, many modifications being conceivable without departing from the spirit and scope of the appended claims.

I claim:

1. A creasing apparatus comprising:

a male part provided with one or more bars;

a female part corresponding to the male part, the female part having a surface and being provided with one or more grooves formed in the surface adapted to receive the bars; and one or more elastic material elements inlaid in the grooves of the female part, the elastic material elements being compressible by the bars, when packaging material is positioned between the bars and the elastic material elements and the bars are received in the grooves, such that the elastic material elements are held in contact with one side of the packaging material to reduce stress in the packaging material, wherein the elements have at least two T-shaped end pieces which are inlaid in the grooves of the female part such that the elements are locked in the grooves.

2. The creasing apparatus as claimed in claim 1, wherein the T-shaped end pieces are inlaid in the grooves of the female part such that the element is pretensioned.

3. The creasing apparatus as claimed in claim 1, wherein the elastic material elements have a sectional profile which corresponds to the shape of the grooves.

4. The creasing apparatus as claimed in claim 1, wherein different elements are arranged in a crease pattern.

5. The creasing apparatus as claimed in claim 1, wherein at least one of the male and female parts is a roller.

6. The creasing apparatus as claimed in claim 1, wherein at least one of the male and female parts is a plate.

7. A creasing apparatus comprising:

a male part provided with one or more bars;

a female part corresponding to the male part, the female part having a surface and being provided with one or more grooves formed in the surface adapted to receive the bars; and one or more elastic material elements inlaid in the grooves of the female part, the elastic material elements being compressible by the bars, when packaging material is positioned between the bars and the elastic material elements and the bars are received in the grooves, such that the elastic material elements are held in contact with one side of the packaging material to reduce stress in the packaging material, wherein the elements are pretensioned by 2–20% in the longitudinal direction of the grooves.

8. The creasing apparatus as claimed in claim 7, wherein different elements are arranged in a crease pattern.

9. The creasing apparatus as claimed in claim 7, wherein at least one of the male and female parts is a roller.

10. The creasing apparatus as claimed in claim 7, wherein at least one of the male and female parts is a plate.

* * * * *